United States Patent [19]

Marley et al.

[11] Patent Number: 4,790,335

[45] Date of Patent: Dec. 13, 1988

[54] TOBACCO CURER

[76] Inventors: James A. Marley, 2448 Owen Dr., Fayetteville, N.C. 28306; Eugene W. Blount, 244 Wallstone Rd., Fayetteville, N.C. 28301

[21] Appl. No.: 49,932

[22] Filed: May 15, 1987

[51] Int. Cl.[4] ..... A24B 3/10; A24B 3/18

[52] U.S. Cl. ..... 131/304; 131/306

[58] Field of Search ..... 131/302, 303, 304, 305, 131/306

[56] References Cited

U.S. PATENT DOCUMENTS 951,650 3/1910 Miller ..... 131/304

1,017,713 2/1912 Vaughan ..... 131/304

*Primary Examiner*—Vincent Millin

*Assistant Examiner*—S. Cheng

*Attorney, Agent, or Firm*—Rhodes, Coats & Bennett

[57] ABSTRACT

A method and apparatus for curing tobacco is provided wherein each leaf is conveyed through a dual chamber curer. The stem of the tobacco leaf is disposed within the upper chamber while the leaf is disposed within the lower chamber. A pre-determined temperature difference is maintained between upper and lower chambers so that the stem and leaf are cured in approximately the same time period thereby preventing overcuring of the leaf.

10 Claims, 3 Drawing Sheets

TOBACCO CURER

FIELD OF THE INVENTION

The present invention relates generally to a method and apparatus for curing tobacco and more particularly to a method and apparatus for curing tobacco which utilizes a dual chamber tobacco curer and a forced air system for separately curing the leaf and the stem.

BACKGROUND OF THE INVENTION

Before the introduction of bulk curing in the early 1960's, tobacco was flue-cured in curing barns by means of heated air in a period of about six days. In conventional or flue-curing, the initial procedures involve stringing groups of tobacco leaves, also known as hands, to a tobacco stick. A string is used to tie the stems of the leaves comprising each hand together and to successively fasten a plurality of hands to a tobacco stick. The strung tobacco sticks are then supported in vertically and horizontally spaced relation on horizontal tier poles within the curing barn. To effect the curing, burners within the barn heat the air and establish a natural convection current from the bottom of the barn, through the leaves, and out the top of the barn.

The advent of bulk curing in the early 1960's reduced the amount of labor required in handling the tobacco leaves during the curing operation by eliminating the stringing procedures. Instead of stringing the tobacco on sticks, the leaves are loaded in mass within bulk curing racks which hold the tobacco leaf in a generally compacted bulk mass with the flat surfaces of the leaves extending generally in a vertical direction. Because of the compact relation of the leaves, bulk curing requires the forced air flow through the compact, bulk mass of leaves in order to affect curing of the leaves.

The curing of tobacco, whether in the conventional manner or by bulk curing, has essentially three stages:

1. The yellowing stage;
2. The leaf drying or color setting stage; and
3. The stem drying or killing out stage.

During the yellowing stage, the green color of the leaf produced by the cholorphyll content vanishes as the cholorphyll breaks down and a yellow color resulting from the carotene content appears. Another important change during the yellowing stage is the conversion of starch to sugar. Although independent, the conversion of starch to sugar and the breakdown of cholorphyll occur simultaneously. Thus, yellowing is a useful, visual measure of sugar formation. During the leaf drying and stem drying stages, the temperature of the air is gradually increased to affect the removal of moisture first from the mesophyll and then the stem of the tobacco leaves.

Impatience in curing frequently result in the temperature being raised too rapidly, causing inter alia, insufficient fermentation, brown scald, etc. For instance, if the temperature is advanced before the yellowing stage is completed, the green color may be set and certain chemical and biological processes which convert the starch to sugar will be stopped. Then the cured tobacco may give a harsh and irritating smoke. Similarly, if the temperature is advanced too rapidly and while there is excessive moisture in the leaf, the oxidation rate of polyphenols within the leaf will be excessive resulting in brown scald. Impatience in curing may also result in allowing insufficient time to "kill" the stems resulting in what is known as swell stem. These conditions all effect the quality and therefore the price of the cured tobacco.

SUMMARY AND OBJECTS OF THE INVENTION

After much research and study into the foregoing problems, the present invention was developed to provide a method and apparatus for curing tobacco utilizing a dual chamber tobacco curer to more accurately control the drying of the leaf and stem and thus avoid the problem of brown scald, early color setting, and other frequently occuring problems associated with conventional flue-curing and bulk curing processes. This is accomplished by supporting the tobacco leaves on a chain conveyor within the dual chamber tobacco curer with the stem and the remaining portions of the leaf being disposed in separate chambers. Independent forced air circulating systems are provided for the dual chambers so that a temperature differential is maintained between the air flow used to dry the stem and the air flow used to dry the remaining portions of the leaf.

Accordingly, it is the primary object of the present invention to provide a forced air system for curing tobacco wherein heated air of different temperatures is utilized to independently cure the stem and the remaining portions of the tobacco leaf.

Another object of the present invention is to provide a tobacco curing system which utilizes the distinct dual chambers wherein heated air of different temperatures is circulated within each chamber.

Another object of the present invention is to provide a tobacco curing system wherein the individual tobacco leaves are supported on a conveyor which tranports the leaf through the dual chamber tobacco curer in combination with a forced air system thereby greatly reducing the time needed to effect the curing of the tobacco leaf.

Another object of the present invention is to provide a tobacco curing system which simplifies the handling of the tobacco thereby reducing the labor cost of the present system when compared with conventional harvesting, handling and curing processes.

A further object of the present invention is to provide a tobacco curing system wherein each tobacco leaf Other objects and advantages of the present invention will become apparent and obvious from a study of the following description and the accompanying drawings which are merely illustrative of such invention.

DETAILED DESCRIPTION OF THE INVENTION

Figure 1:
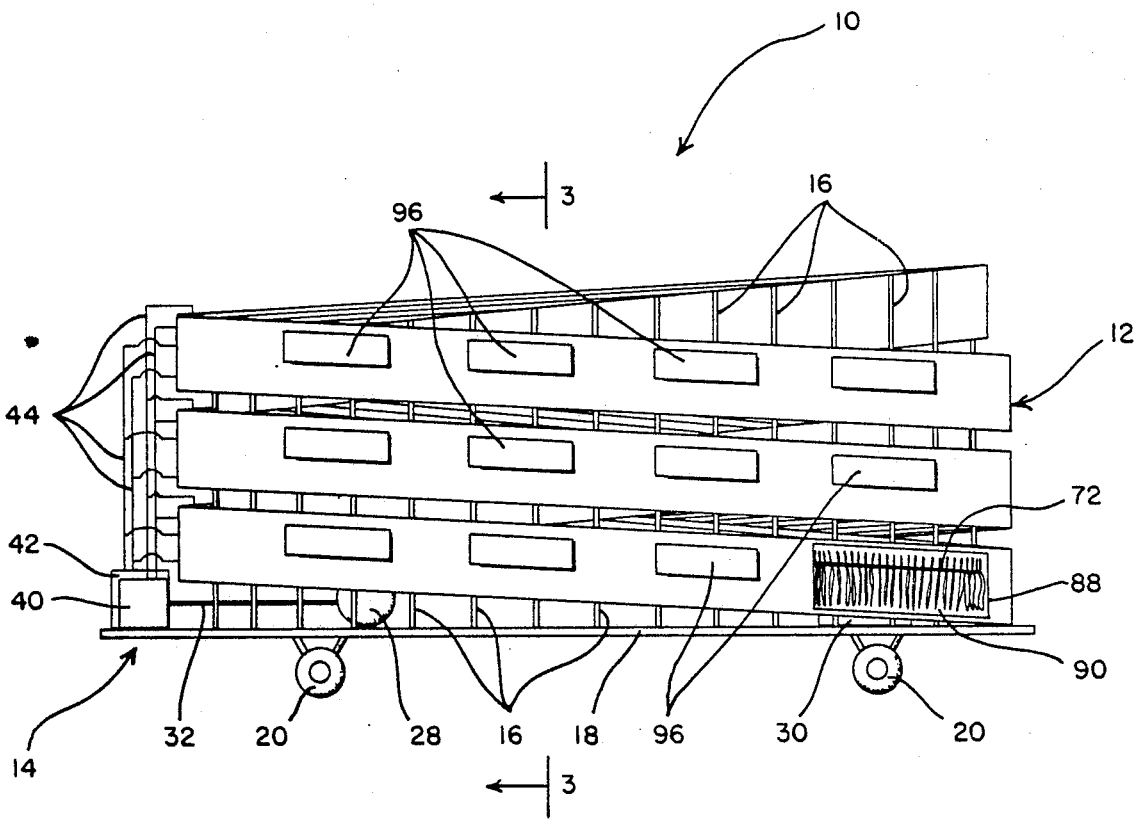
FIG. 1 is an elevational view of the tobacco curing system of the present invention.

With reference to the drawings, the tobacco curing of the present invention is shown therein and indicated generally by the numeral 10. The tobacco curing system 10 of the present invention includes a closed, dual chamber duct system indicated generally at 12 in the form of a double helical. The duct system 12 is supported on a trailer 14 by frame members 16. Trailer 14 includes a bed 18 supported on wheels 20 on parallel axis 22. Since flat bed trailers of the type described herein are well-known to those skilled in the art, a detailed discussion of the same is not deemed necessary.

Dual forced air heating systems 24 and 26 are mounted on bed 18 of trailer 14, as well as a gas tank 28 and generator 30. Supply line 32 extends on gas tank 28 to a T-joint 34. Secondary supply lines 36 and 38 connect the T-joint 34 to respective heater/blowers 40 and 42. Air supply lines 44 and 46 communatively connect respective heater blowers 40 and 42 to respective chamber within the dual chamber duct system 12.

Figure 6:
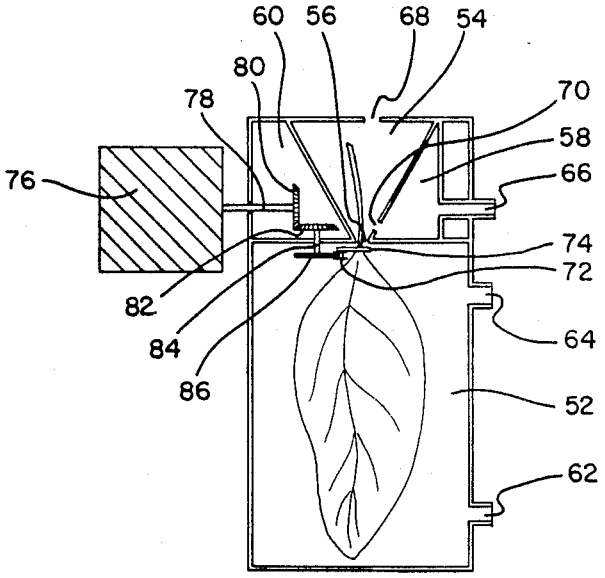
FIG. 6 is a typical section view of a duct thereof.

Referring now to the dual chamber duct system 12 the same is in the form of a double helical and includes an outer spiral 48 and an inner spiral 50. A typical section of the duct system 12 is shown in FIG. 6. Duct system 12 includes a lower leaf chamber 52 and an upper stem chamber 54 separated by a slot-like opening 56. Leaf chamber 52 has a generally rectangular configuration and encloses the main portion of the tobacco leaf. The upper chamber 54, has a generally triangular configuration and encloses the stem of the tobacco leaf. Auxillary chambers 58 and 60 are disposed on either side of the stem chamber 54 above leaf chamber 52, the purpose of which will become apparent from subsequent portions of this specification.

A plurality of inlet ports 62 and outlet ports 64 are longitudinally spaced along the entire length of the leaf chamber 52, and are vertically spaced with respect to each other as can be clearly seen in FIG. 6. Inlet ports 62 are communicatively connected to heater/blower 40 which is rated at approximately fifty thousand British thermal units. Heated air enters leaf chamber 52 through inlet port 62 in a direction substantially parallel to the surfaces of the tobacco leaf disposed therein. The heated air circulates through the leaf chamber 52 and exits through outlet ports 64 carrying with it moisture which is picked up from the tobacco leaf.

Similarly, a second inlet port 66 is formed in auxillary chamber 58 while an outlet port 68 if formed in the stem chamber 54. Inlet port 66 is connected to heater/blower 42 which is rated at approximately 75,000 BTU. An air passage 70 is formed in the wall separating the auxillary chamber 58 from the stem chamber 54 which directs the heated air to the portion of the stem closest to the leaf. The heated air then circulates upwardly through the stem chamber and exits through the oulet port 68.

During the curing process, the tobacco leaves are supported from a continuous chain conveyor 72 by means of clamps 74. The clamps 74 are disposed within the slot-like opening 56; the stem of the tobacco leaf being held within the clamps 74. Since chain conveyors and clamps of the type herein described are well known to those of ordinary skill in the art, a further detail discussion of the same is not deemed necessary.

Figure 2:
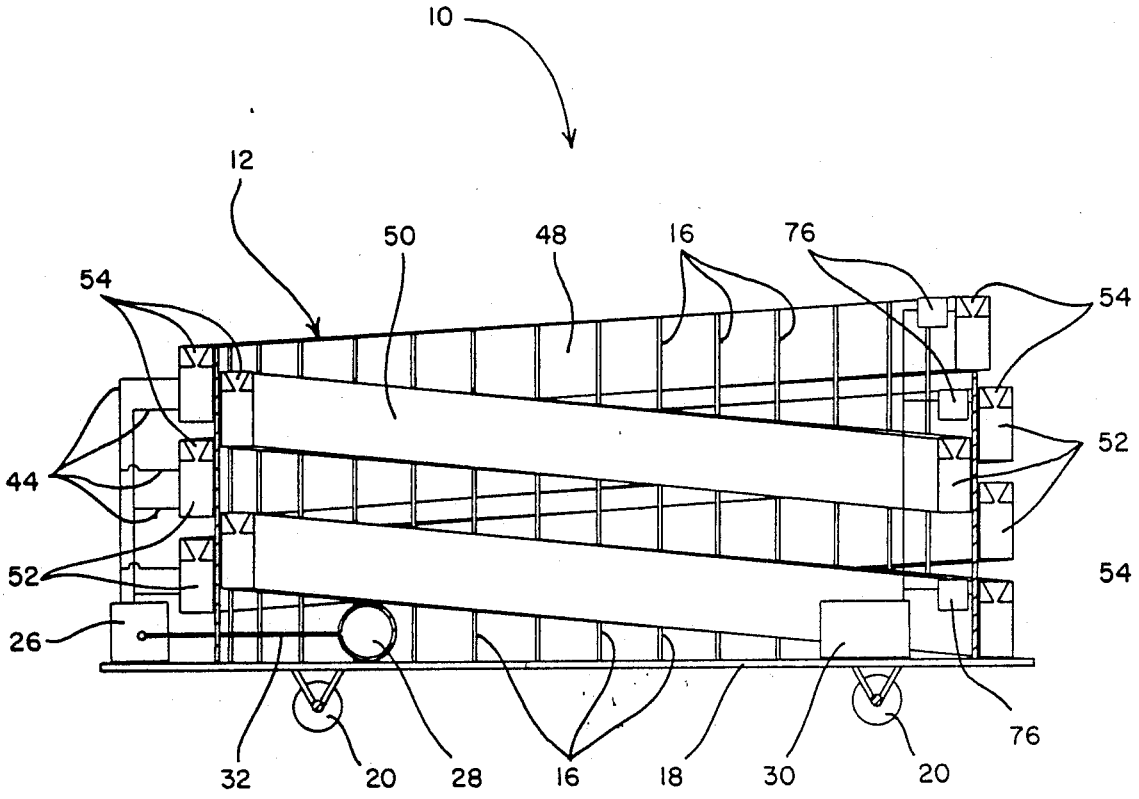
FIG. 2 is a longitudinal section view thereof.
Figure 3:
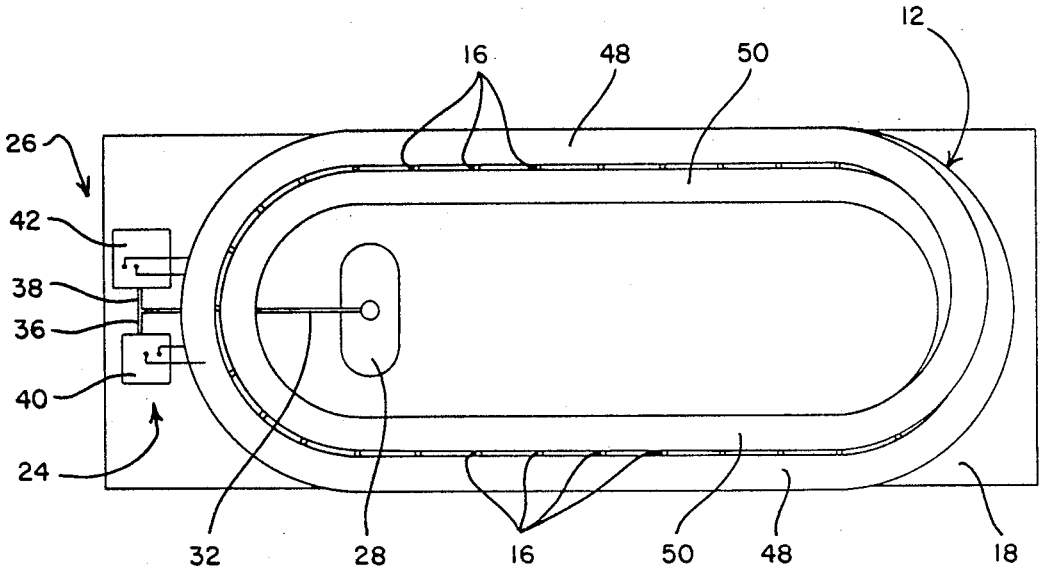
FIG. 3 is a top view thereof.
Figure 4:
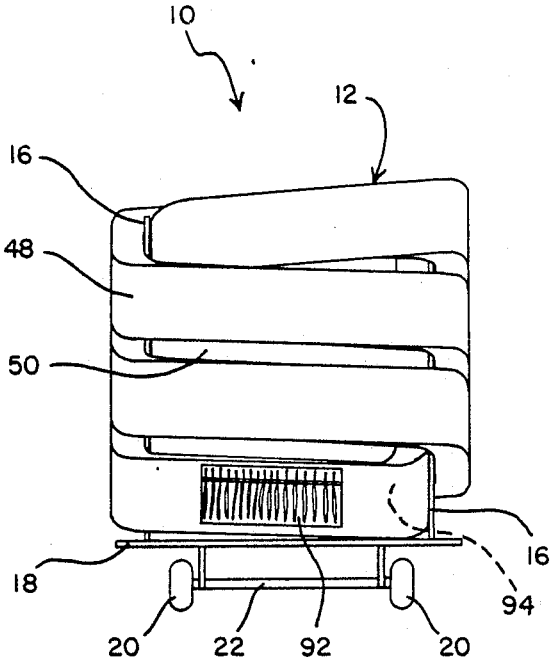
FIG. 4 is an end view thereof.
Figure 5:
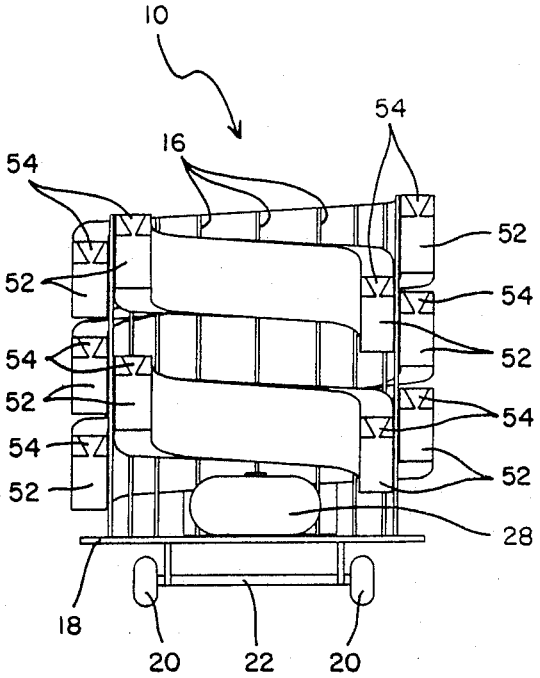
FIG. 5 is a transverse section view thereof.

The chain conveyor 72 is driven by a plurality of motors 76 which are spaced in vertical relationship at one end of the duct system 12. (FIG. 2) A drive gear 80 is mounted on the motor shaft 78 which drives gear 82 at one end of chain drive shaft 84. (FIG. 6) A chain drive gear 86 is mounted at the opposite end of chain drive shaft 84 and drives the chain conveyor 72 at a predetermined rate of speed. In the preferred embodiment of the present invention, the chain conveyor moves at approximately 6 feet 4 inches per minute.

To use the tobacco curring system 10 of the present invention, the tobacco leaves are individually supported from the chain conveyor 72 by inserting the stems of tobacco leaves into chamber 74. The tobacco is loaded through an access opening 88 formed in the lower tier of the outer spiral 48. (FIG. 1). When properly loaded, the flat surfaces of the tobacco leaves should substantially fill the lower leaf chamber 52 of the duct system 12 while the stem projects through the slot-like opening 56 into the upper stem chamber 54. (FIG. 6) The tobacco leaves are then conveyed upwardly through the outer spiral 48. At the top of the outer spiral the tobacco leaf crosses over to the inner spiral and is conveyed downwardly therethrough until reaching the dropping out chamber 92 which is preferably adjacent the loading chamber 90. Thus, a continuous closed duct system 12 in the form of a double helical is provided.

As the tobacco leaves are conveyed through duct system, heated air is blown in through longitudinally spaced inlet ports 62 and 66 in a direction substantially parallel to the flat surfaces of the tobacco leaf to effect first the yellowing of the leaf and stem and secondly, the drying of the mesophyll and stem. It is appreciated that the temperature of the heated air is gradually increased as the leaf progresses through the duct system 12 and further that the heated air which is blown into the upper stem chamber 54 is somewhat hotter than the heated air blown into the lower leaf chamber 52. This allows the stem to be completely dried without the risk of advancing the temperature too rapidly while excessive moisture is in the tobacco leaf and thus avoids the problems of brown scald and swell stem.

In the preferred embodiment of the present invention, approximately 10 feet of the duct system 12 serves as a loading chamber 90, and another 10 feet serves as a dropping out chamber 92. The length of the duct system 12 between the loading chamber 90 and dropping out chamber 92 should be approximately 342 feet. With the leaf being conveyed at approximately 6 feet 4 inches per minute, the temperature in the leaf chamber 52 and stem chamber 54 should be advanced in accordance with the following schedule:

LEAF CHAMBER

114 Feet - 105 to 110 degrees
38 Feet -120 degrees
76 Feet - 150 degrees
76 Feet - 175 degrees
38 Feet - 180 degrees

STEM CHAMBER

76 Feet - 130 degrees
76 Feet - 180 degrees
76 Feet - 220 degrees
76 Feet - 240 degrees
38 Feet - 250 degrees Although the above schedule is sufficient to cure the tobacco leaves under most conditions, when the tobacco is wet or when unusually high humidity occurs, it maybe necessary to cure the leaf for longer periods of time. This can be accommodated by including a ordering chamber 94 at the end of the curing cycle immediately adjacent the dropping out chamber. The ordering chamber 94 will be constructed in the same manner as the remaining portion of the duct system 12. When additional time is needed to completely dry the tobacco leaf, heated air maybe blown in through the inlet ports in the ordering chamber and circulated therethrough as previously described. If the conditions are normal and the additional time to cure the tobacco is not needed, the inlet ports within the ordering chamber 94 can be closed. This allows for some adjustment of the curing cycle.

From the foregoing, it is apparent that the dual chamber tobacco curing system of the present invention provides an improved method an apparatus for curing tobacco which avoids problems normally associated with flue-curing and bulk curing processes by utilizing separate forced air systems for drying the leaf and stem of the tobacco.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An apparatus for curing tobacco comprising:

(a) a dual chamber duct system for isolating the leaf and stem of the tobacco including an elongated stem chamber for containing the stem of the tobacco, an elongated leaf chamber adjacent to but separated from the stem chamber for containing the leaf of the tobacco, and an elongated slot-like opening communicating between said stem chamber and said leaf chamber through which the stem of the tobacco extends;

(b) means for conveying said tobacco lengthwise through said duct system, with the leaf of the tobacco taking up a substantial portion of the cross-sectional area of said leaf chamber and the stem of the tobacco projecting through said slot-like opening into said stem chamber; and (c) an air circulating means for heating and circulating air through said stem chamber and said leaf chamber while said tobacco is conveyed through said duct system said air circulating means including means for independently controlling the temperature of the air within the leaf and stem chambers respectively.

2. The apparatus of claim 1 wherein said conveyor means includes a continuous, chain conveyor which extends through said duct system and means for supporting said tobacco from said chain conveyor.

3. The apparatus of claim 2 wherein said means for supporting said tobacco includes a plurality of clumps secured to said chain conveyor in spaced relation for engaging the stems of said tobacco.

4. The apparatus of claim 1 wherein said duct system is a continuous, closed loop duct system.

5. The apparatus of claim 4 wherein said duct system is in the form of a double helical.

6. The apparatus of claim 1 wherein said air circulating means includes means for varying the temperature of the heated air circulated through said stem chamber and said leaf chamber so as to establish distinct longitudinally spaced temperature zones through which said tobacco is sequentially conveyed.

7. The apparatus of claim 6 wherein said temperature zones gradually increase in temperature from the beginning to the end of said duct system so as to effect first the yellowing of said tobacco and then the drying of the leaf and stem.

8. A method for curing tobacco in a curer including an elongated stem chamber adjacent to but separated from said leaf chamber, and a slot-like opening communicating between the leaf chamber and stem chamber, said method comprising:

(a) isolating the leaf and stem of the tobacco by placing tobacco within said curer so that the leaf of the tobacco is disposed in said leaf chamber and the stem of the tobacco projects through said slot-like opening into said stem chamber; and (b) circulating heated air of different temperature through said leaf chamber and stem chamber respectively to effect the curing of the tobacco.

9. The method according to claim 8 further comprising the step of conveying said tobacco lengthwise through said curer while simultaneously circulating heated air through said leaf chamber and stem chamber.

10. The method according to claim 9 further comprising the step of varying the temperature of the heated air circulated within the stem and leaf chamber to establish distinct temperature zones distributed through which the tobacco is sequentially conveyed.

* * * * *